US005362301A

United States Patent [19]

Malekmadani et al.

[11] Patent Number: 5,362,301

[45] Date of Patent: Nov. 8, 1994

[54] FIXED-ANGLE COMPOSITE CENTRIFUGE ROTOR

[75] Inventors: Mohammad G. Malekmadani, Scotts Valley; Reza M. Sheikhrezai, San Jose; William J. Cassingham, Grass Valley, all of Calif.

[73] Assignee: Composite Rotors, Inc., Santa Clara, Calif.

[21] Appl. No.: 79,964

[22] Filed: Jun. 21, 1993

Related U.S. Application Data

[63] Continuation of Ser. No. 896,162, Jun. 10, 1992, abandoned.

[51] Int. Cl.[5] ..... B04B 5/02; B04B 7/08

[52] U.S. Cl. ..... 494/16; 494/81; 74/572

[58] Field of Search ..... 494/16-21, 494/31, 33, 43, 44, 81, 85; 422/49, 72; 74/572, 573 R, 574; 210/360.1

[56] References Cited

U.S. PATENT DOCUMENTS

| | | | |
|---|---|---|---|
| 3,248,046 | 4/1966 | Feltman, Jr. et al. | 494/16 |
| 3,788,162 | 1/1974 | Rabenhorst et al. | 74/572 |
| 3,913,828 | 10/1975 | Roy . | |
| 4,207,778 | 6/1980 | Hatch | 74/572 |
| 4,266,442 | 5/1981 | Zorzi | 74/572 |
| 4,413,860 | 11/1983 | Prescott | 74/572 X |
| 4,468,269 | 8/1984 | Carey | 156/175 |
| 4,701,157 | 10/1987 | Potter | 494/81 X |
| 4,738,656 | 4/1988 | Piramoon et al. | 494/81 |
| 4,781,669 | 11/1988 | Piramoon | 494/16 |
| 4,790,808 | 12/1988 | Piramoon | 494/81 |
| 4,817,453 | 4/1989 | Breslich, Jr. et al. | 494/16 X |
| 4,824,429 | 4/1989 | Keunen et al. | 494/81 X |
| 4,860,610 | 8/1989 | Popper et al. | 74/572 |
| 4,991,462 | 2/1991 | Breslich, Jr. et al. | 74/572 |
| 5,057,071 | 10/1991 | Piramoon | 494/16 |

FOREIGN PATENT DOCUMENTS

| | | | |
|---|---|---|---|
| 969780 | 6/1975 | Canada | 74/572 |
| 2453650 | 5/1975 | Germany | 494/81 |
| 4830431 | 9/1973 | Japan | 494/81 |
| 49-38671 | 10/1974 | Japan | 494/81 |
| 54-21477 | 2/1979 | Japan | 74/572 |
| 58-33408 | 7/1983 | Japan | 74/572 |

OTHER PUBLICATIONS

"Advanced Centrifuge Rotors", published by KOMP-spin Technologies, Inc.

"Instructions For Using The VC53 Vertical Tube Rotor", published by Spinco Division of Beckman Instruments, Inc.

A one-page brochure on Savant HSC15R Refrigerated Microcentrifuge.

*Primary Examiner*—Timothy F. Simone
*Assistant Examiner*—Charles Cooley
*Attorney, Agent, or Firm*—Limbach & Limbach

[57] ABSTRACT

A fixed-angle centrifuge rotor fabricated from fiber-reinforced composite material includes fibers for reinforcing radially outer portions of the cell holes in a direction transverse to the laminated layers of the rotor core. In one embodiment, the reinforcement fibers are in a reinforcement shell of fiber-reinforced composite material wound over the periphery of the rotor core. In another embodiment, the reinforcement fibers are in a reinforcement cup of fiber-reinforced composite material bonded into each of the cell holes. In a third embodiment, the reinforcement fibers are in a formed region of the laminated layers to orient the fibers therein obliquely to the rotor axis.

8 Claims, 13 Drawing Sheets

FIXED-ANGLE COMPOSITE CENTRIFUGE ROTOR

This is a continuation of co-pending application Ser. No. 07/896,162 filed on Jun. 10, 1992 now abandoned.

BACKGROUND OF THE INVENTION

Field of the Invention

This invention relates generally to centrifuge rotors, and relates more particularly to a fixed-angle rotor fabricated and reinforced with composite materials.

Description of the Relevant Art

Centrifuges are commonly used in medical and biological research for separating and purifying materials of differing densities, such as viruses, bacteria, cells, protein, and other compositions. A centrifuge includes a rotor typically capable of spinning at tens of thousands of revolutions per minute.

There are two major types of centrifuge rotors, continuous flow rotors and preparative rotors. A continuous flow rotor has a large central cavity to accept the sample, which is pumped into the central cavity. Separated fluids are continuously pumped out of a continuous flow rotor. This type of rotor constitutes a small portion of the market.

The other type of centrifuge rotor is a preparative rotor, which is the subject of this patent application. A preparative centrifuge rotor has some means for accepting tubes or bottles containing the samples to be centrifuged. Preparative rotors are commonly classified according to the orientation of the sample tubes or bottles. Vertical tube rotors carry the sample tubes or bottles in a vertical orientation, parallel to the vertical rotor axis. Fixed-angle rotors carry the sample tubes or bottles at an angle inclined with respect to the rotor axis, with the bottoms of the sample tubes being inclined away from the rotor axis so that centrifugal force during centrifugation forces the sample toward the bottom of the sample tube or bottle. Swinging bucket rotors have pivoting tube carriers that are upright when the rotor is stopped and that pivot the bottoms of the tubes outward under centrifugal force.

Many centrifuge rotors are fabricated from metal. Since weight is concern, titanium and aluminum are commonly used materials for metal centrifuge rotors.

Fiber-reinforced, composite structures have also been used for centrifuge rotors. Composite centrifuge rotors are typically made from laminated layers of carbon fibers embedded in an epoxy resin matrix. The fibers are arranged in multiple layers extending in varying directions at right angles to the rotor axis. During fabrication of such a rotor, the carbon fibers and resin matrix are cured under high pressure and temperature to produce a very strong but lightweight rotor. U.S. Pat. Nos. 4781,669 and 4,790,808 are examples of this type of construction. Sometimes, fiber-reinforced composite rotors are wrapped circumferentially with an additional fiber-reinforced composite layer to increase the hoop strength of the rotor. See, for example, U.S. Pat. Nos. 3,913,828 and 4,468,269.

Composite centrifuge rotors are stronger and lighter than equivalent metal rotors, being perhaps 60% lighter than titanium and 40% lighter than aluminum rotors of equivalent size. The lighter weight of a composite rotor translates into a much smaller mass moment of inertia than that of a comparable metal rotor. The smaller moment of inertia of a composite rotor reduces acceleration and deceleration times of a centrifugation process, thereby resulting in quicker centrifugation runs. In addition, a composite rotor reduces the loads on the centrifugal drive unit as compared to an equivalent metal rotor, so that the motor driving the centrifuge will last longer. Composite rotors also have the advantage of lower kinetic energy than metal rotors due to the smaller mass moment of inertia for the same rotational speed, which reduces centrifuge damage in case of rotor failure. The materials used in composite rotors are resistent to corrosion against many solvents used in centrifugation.

In a fixed-angle centrifuge rotor, several cell holes are machined or formed into the rotor at an angle of 5 to 45 degrees, typically, with respect to the rotor axis. The cell holes receive the sample tubes or bottles containing the samples to be centrifuged. Cell holes can be either through holes that extend through the bottom of the rotor, or blind holes that do not extend through the bottom. Through cell holes are easier to machine than blind cell holes, but require the use of sample tube holders inserted into the cell holes to receive and support the sample tubes. Blind cell holes do not require sample tube holders because the bottoms of the cell holes support the sample tubes.

When a centrifuge rotor is constructed from a laminated composite material, blind cell holes can cause delamination of the composite layers. In a vertical axis centrifuge rotor, the reinforcing fibers in the composite layers are horizontal, perpendicular to the rotor axis, which is the best orientation to react the radial centrifugal forces generated during centrifugation. In a fixed-angle composite rotor having blind cell holes, there is a component of the centrifugal force that is transverse to the composite layers. Under centrifugation, the centrifugal forces on a sample tube will be transferred to the outer and bottom walls of the blind cell hole. The loading on the bottom of a blind cell hole is a downward force having a direction and magnitude determined by the angle of the cell hole and the centrifugal force acting on the sample tube. This downward force tries to separate the horizontal layers of fiber reinforcement and, if the force exceeds the strength of the resin, then delamination can occur. Through hole construction can be used to eliminate transverse forces at the bottom of the cell holes, but through cell holes require the addition of metal sample tube holders, which increase the total load exerted on each cell hole, thus increasing the stresses on the rotor. Through hole construction with sample tube holders also increases weight of the rotor and energy required for centrifugation. Also, metal sample tube holders can corrode due to corroding solvents used during centrifugation.

SUMMARY OF THE INVENTION

In accordance with the illustrated preferred embodiment, the present invention provides a fixed-angle centrifuge rotor fabricated from fiber-reinforced composite material, where the rotor includes a rotor core fabricated from multiple layers of fiber-reinforced composite material laminated together with the fibers oriented normal to the rotor axis, one or more cell holes each having a top tilted toward the rotor axis at an oblique angle and a bottom with a radially outer portion, a hub or other means for attaching the rotor to a spindle of a centrifuge, and reinforcement means for reinforcing the radially outer portions of the bottoms of the cell holes in a direction parallel to the rotor axis with fibers oriented obliquely to the rotor axis. In one embodiment, the reinforcement fibers are in a reinforcement shell of fiber-reinforced composite material wound over the periphery of the rotor core. In another embodiment, the reinforcement fibers are in a reinforcement cup of fiber-reinforced composite material bonded into each of the cell holes. In a third embodiment, the reinforcement fibers are in provided by orienting the radially outer portions of the laminated layers obliquely to the rotor axis.

The present invention also encompasses a method for fabricating a fixed-angle centrifuge rotor from fiber-reinforced composite materials. The method includes the steps of fabricating a rotor core of laminated layers of fiber-reinforced composite material with the fibers oriented in multiple layers in varying directions normal to an axis and bound together with resin, fabricating into the rotor core two or more cell holes each oriented at an oblique angle to the rotor axis, and reinforcing the rotor core proximate the cell holes with a fiber-reinforced composite material having fibers oriented obliquely to the rotor axis. Again, the reinforcement of the cell holes can be either with an external reinforcement layer, an internal reinforcement cup, or obliquely oriented radially outer portions of the laminated layers.

The present invention provides a fixed-angle centrifuge rotor fabricated from composite material without the added expense and weight of separate sample tube holders. The present invention uses only composite materials and thus retains the advantages of all-composite construction in terms of light weight, low energy, and corrosion resistance, while overcoming the problems associated with delamination.

The features and advantages described in the specification are not all inclusive, and particularly, many additional features and advantages will be apparent to one of ordinary skill in the art in view of the drawings, specification and claims hereof. Moreover, it should be noted that the language used in the specification has been principally selected for readability and instructional purposes, and may not have been selected to delineate or circumscribe the inventive subject matter, resort to the claims being necessary to determine such inventive subject matter.

DETAILED DESCRIPTION OF THE PREFERRED EMBODIMENT

FIGS. 1 through 9 of the drawings depict various preferred embodiments of the present invention for purposes of illustration only. One skilled in the art will readily recognize from the following discussion that alternative embodiments of the structures and methods illustrated herein may be employed without departing from the principles of the invention described herein.

Figure 1:
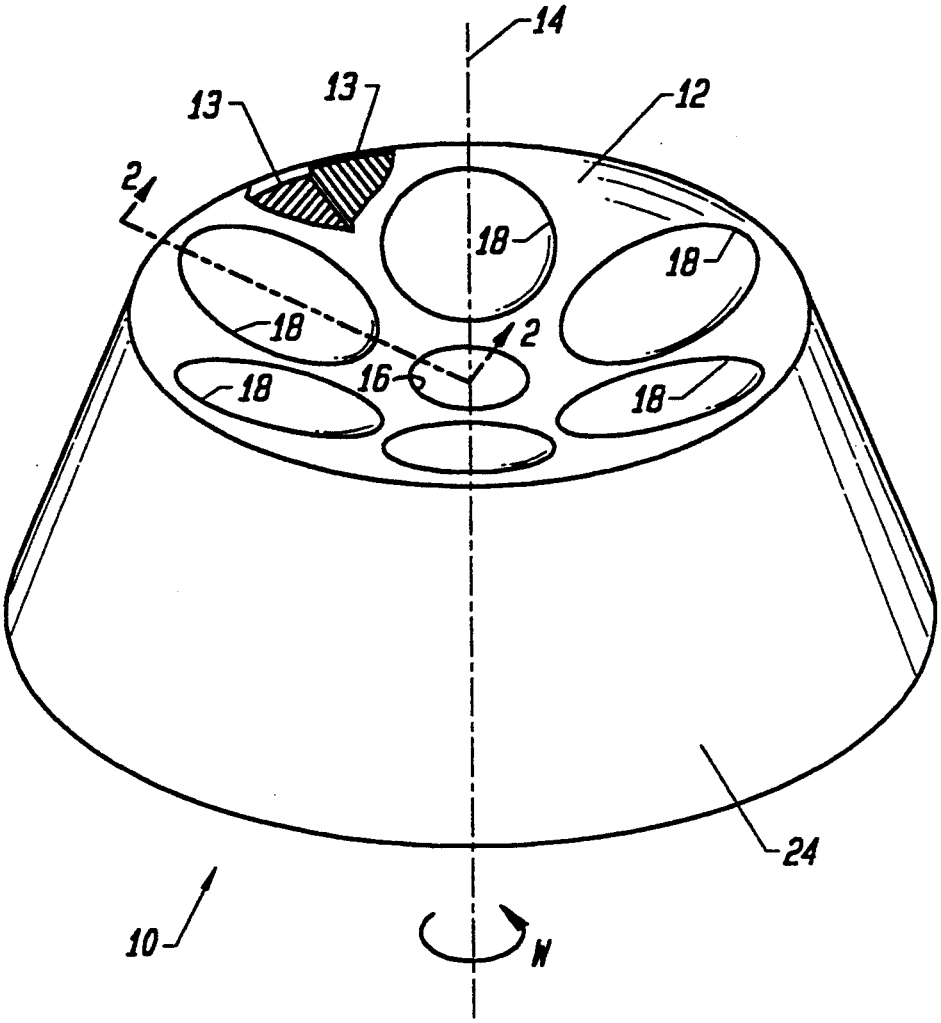
FIG. 1 is a perspective view of a fixed-angle centrifuge rotor.
Figure 2:
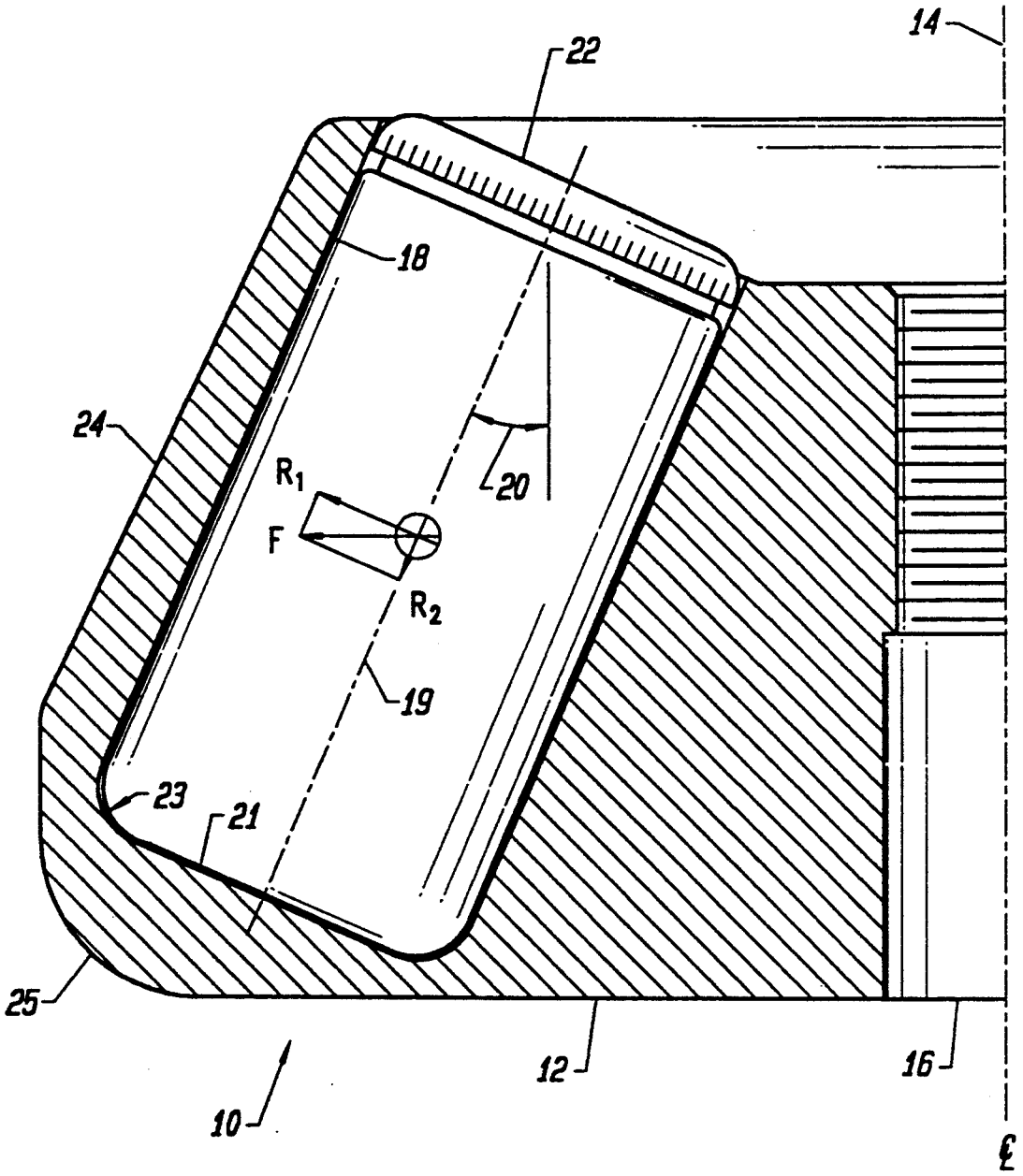
FIG. 2 is a sectional view of the centrifuge rotor of FIG. 1.

The preferred embodiment of the present invention is a fixed-angle centrifuge rotor fabricated from fiber-reinforced composite material, and an associated method of fabrication. FIGS. 1 and 2 illustrate a fixed-angle centrifuge rotor 10. The rotor 10 has a core 12 fabricated of several hundred parallel layers 13 of resin-coated carbon fibers. The fiber layers are oriented at a right angle to the axis 14 of the rotor 10 to provide the optimum strength against centrifugal forces generated when the rotor is rotating. The rotor 10 includes a hub 16 that mounts to a spindle of a centrifuge machine (not shown) that spins the rotor about its axis 14. The rotor 10 includes six cell holes 18, each oriented with its axis 19 intersecting the rotor axis 14 at an oblique angle 20. All of the cell holes are preferably oriented at the same oblique angle with respect to the rotor axis, although this is not necessary. For symmetry, however, it is preferred that opposite cell holes be oriented at the same oblique angle. The bottom 21 of each cell hole 18 includes a radially outer portion 23 that is reinforced by means explained below. Each cell hole 18 receives a sample tube or bottle 22 containing the materials to be centrifuged. The outer periphery 24 of the rotor 10 is a truncated cone with a rounded bottom edge 25.

During centrifugation, the sample imparts forces on the rotor that tend to delaminate the layers of the rotor core, especially at the radially outer portion 23 of the bottoms of the cell holes. As shown in FIG. 2, a centrifugal force F acts on the sample bottle 22 and its contents. Since the cell holes are not parallel to the rotor axis, the centrifugal force tends to move the sample bottle 22 downward toward the bottom 21 of the cell hole 18. Force F can be resolved into two component forces $R_1$ and $R_2$, with force $R_1$ acting normal to the outer wall of the cell hole 18 and force $R_2$ acting parallel to the wall. Force component $R_2$ is the force of the sample bottle 22 on the bottom of the cell hole 18, and has an axially downward component that tends to separate the radial layers of fiber in the rotor core 12. In addition, force component $R_1$ has an upward axial component that tends to separate the radial layers of fiber in the rotor core. These axial forces can cause delamination in the radially outer region 23 if they exceed the transverse strength of the fiber-reinforced composite rotor core.

Figure 3A:
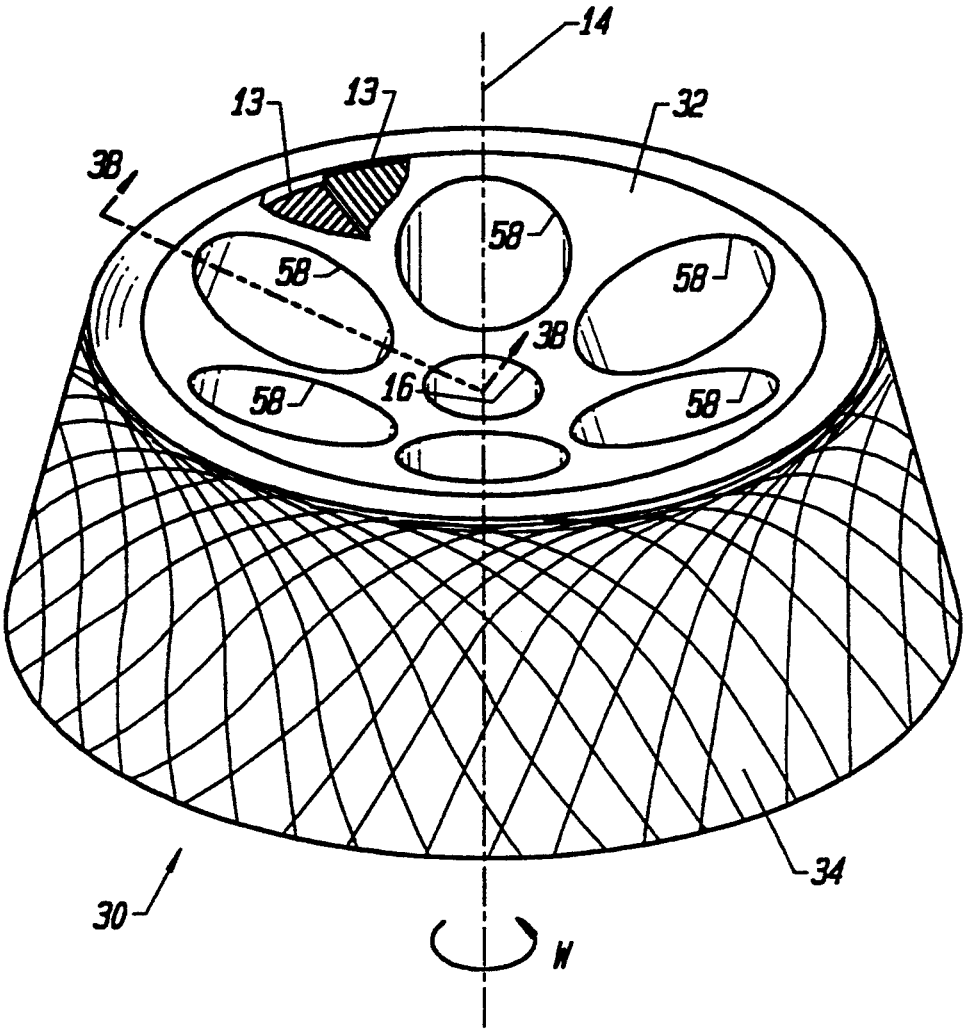
FIGS. 3A and 3B are a perspective view and a sectional view, respectively, view of a fixed-angle centrifuge rotor of the present invention illustrating an embodiment of the invention that reinforces the outside of the rotor with a reinforcement shell.
Figure 3B:
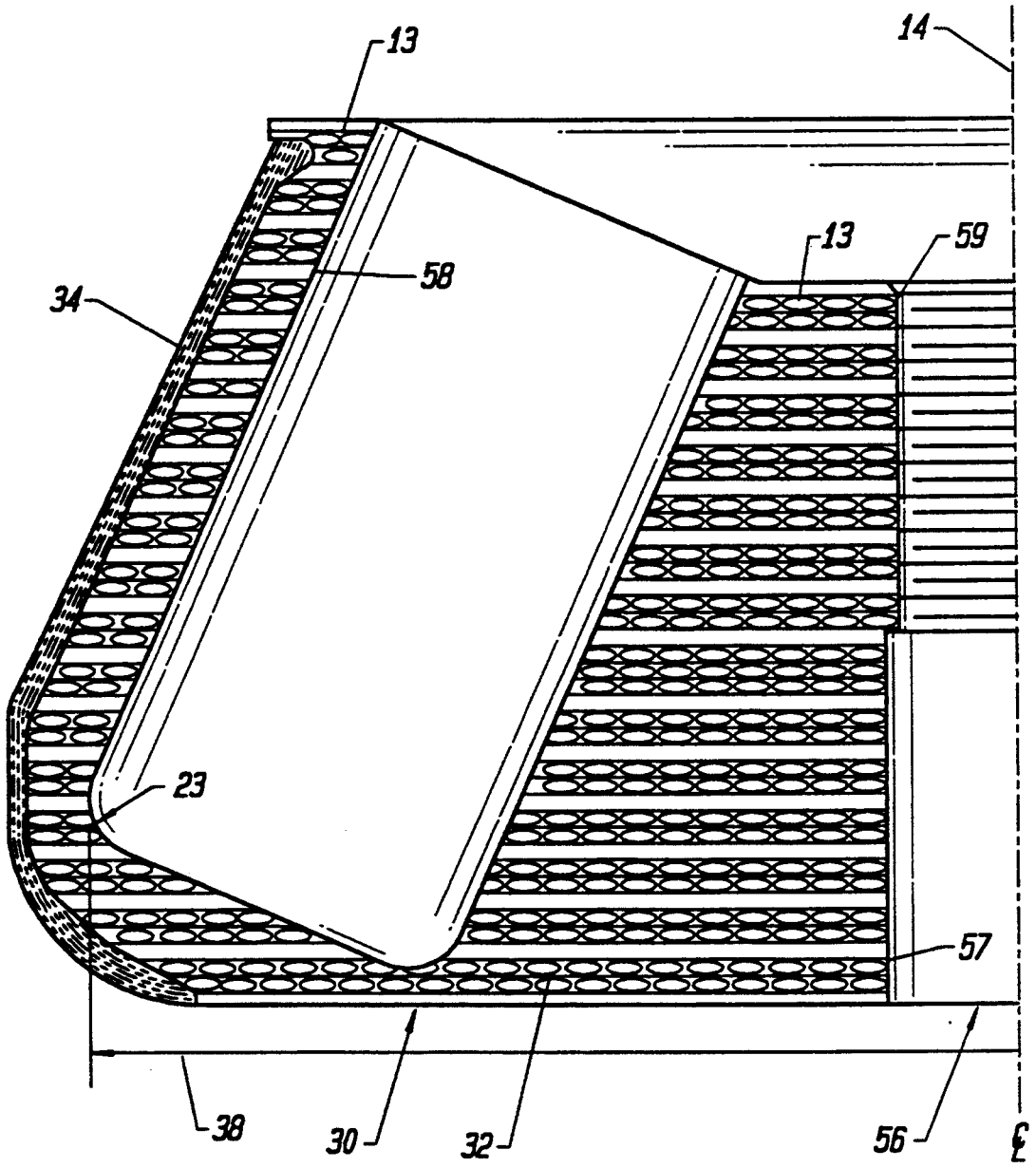

FIGS. 3A and 3B illustrate one embodiment of the present invention that solves the problem associated with fixed-angle rotors loading the bottom of blind cell holes. Rotor 30 has a rotor core 32 fabricated like rotor 10 of FIGS. 1 and 2. In addition, rotor 30 has a reinforcement shell 34 of fiber-reinforced composite material bonded to the outer periphery of the rotor. The reinforcement shell 34 has fibers wound helically with respect to the rotor axis 14 so that the fibers lay in part in a direction transverse to the radial layers of fiber in the rotor core. The reinforcement shell 34 forms a solid shell around the laminated rotor core when cured. This shell is very strong in a direction parallel to the rotor axis due to the orientation of the helically-wound fiber reinforcement in the shell. The shape of the reinforcement shell 34 is designed to surround the radially outer region 23 of the cell holes. In other words, the reinforcement shell 34 extends both above and below the high-stress region 23 to strengthen the rotor in a direction transverse to the laminate layers. The reinforcement shell 34, in effect, clamps the laminates of the rotor core from the top and bottom and prevents delamination of the rotor core at the radially outer region 23 of the bottoms of the cell holes 18.

The reinforcement shell 34 shown in FIGS. 3A and 3B extends to the top of the rotor on its upper side. However, the reinforcement shell need not extend upward as far as is shown in FIG. 3B. In order to provide transverse strength to the radially outer region 23, the reinforcement shell need extend to a point above and below the region 23. In the rotor of FIG. 3, this could be accomplished by extending the shell about half way up the sides of the rotor. In other words, both the top and bottom edges of the reinforcement shell 34 extend radially inward to a radius less than the radius 38 of the radially outer region 23 of the bottoms of the cell holes.

Figure 4:
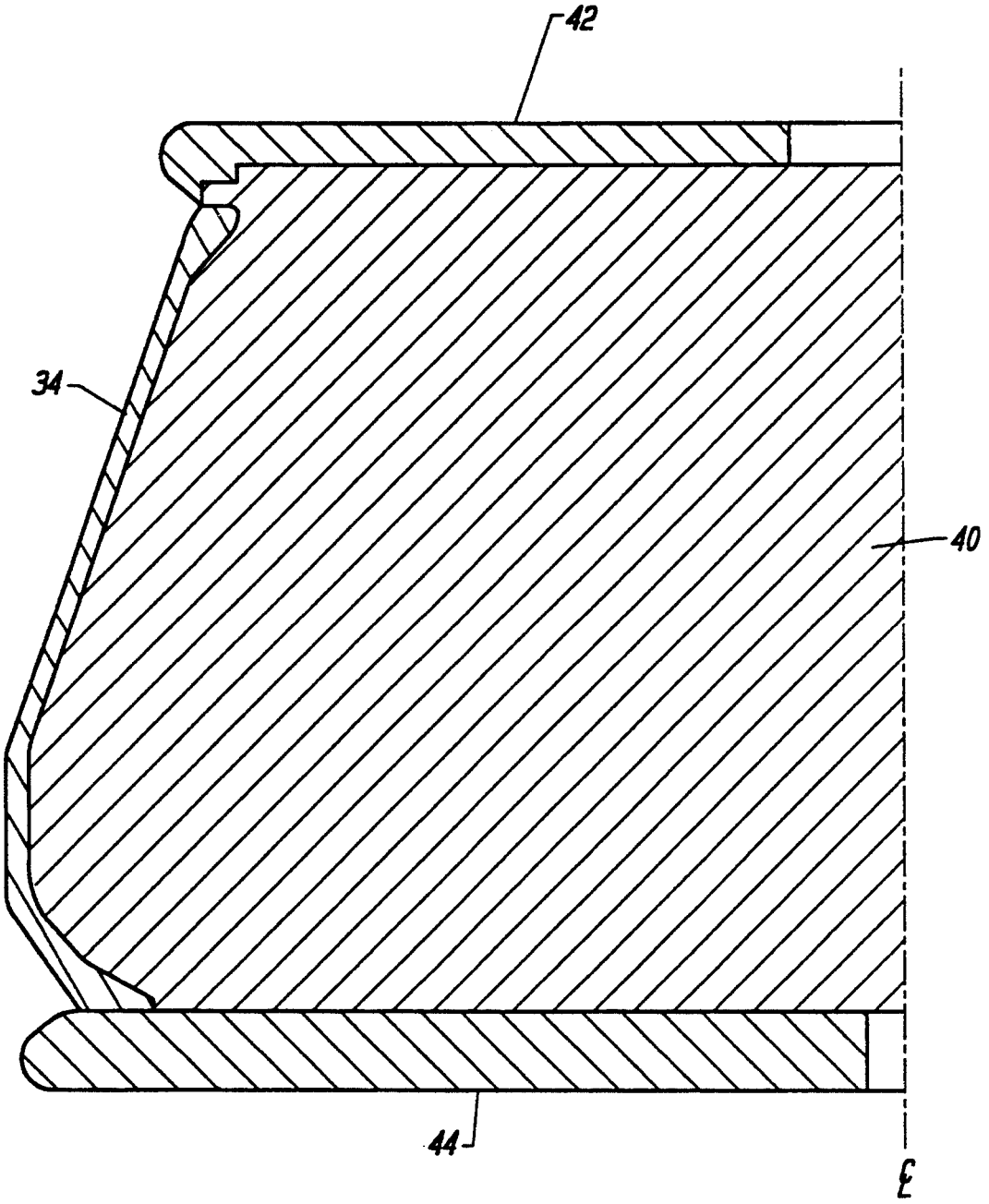
FIG. 4 is a sectional view of the rotor of FIGS. 3A and 3B during fabrication.
Figure 5:
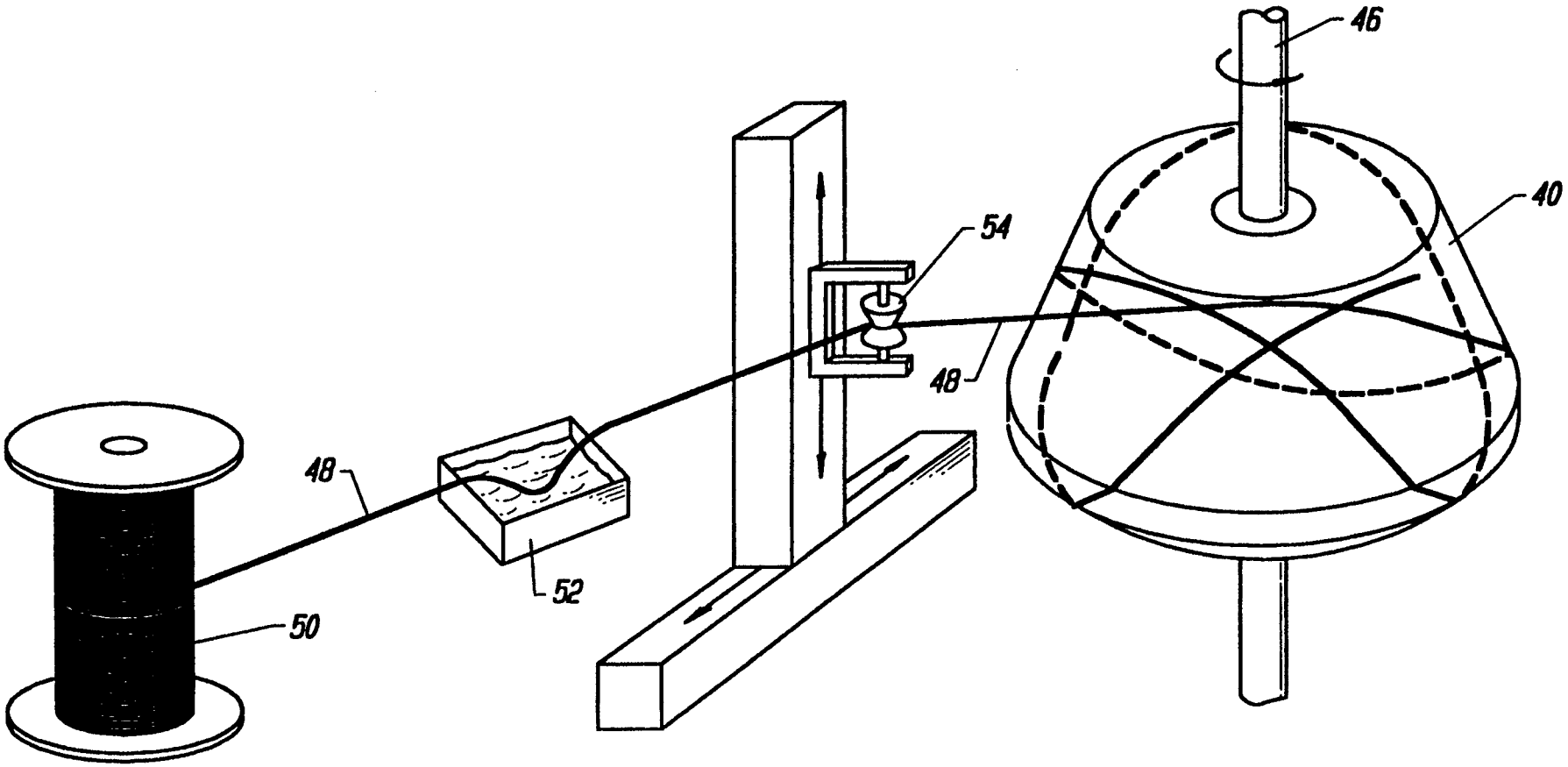
FIG. 5 is a perspective view of the rotor of FIG. 4 and equipment used in its fabrication.

The fabrication of the reinforcement shell 34 of rotor 30 is illustrated in FIGS. 4 and 5. First, a rotor core is fabricated by laminating several hundred layers of unidirectional carbon fiber / epoxy prepregnated tape oriented at right angles to the rotor axis. The tape is made of longitudinally continuous fiber and coated with epoxy resin. A typical tape is about 0.010 inch thick and contains about 65% fiber and 35% resin by weight. The tape is cut, indexed to a predetermined repeating angle, and stacked to the height of the rotor. The stack is then placed in a mold and cured under pressure at elevated temperatures to obtain a solid billet. Then, the billet is machined into the rough shape of a rotor core with an axis at right angles to the plane of the tapes.

After the billet is machined, it has a shape 40 shown in FIG. 4 and is ready for the addition of the reinforcement shell 34 by helically winding a continuous filament of resin dipped fiber onto the outer periphery of the billet. The apparatus illustrated in FIG. 5 is used to dip the carbon fiber filament into resin and wind the carbon fiber tape onto the outside of the machined billet. The rotor billet 40 is sandwiched between two circular plates 42 and 44 and then placed on a rotating spindle 46. As the spindle 46 rotates, the filament 48 is wound onto the rotor in a helical pattern. The filament 48 is supplied by a spool 50 and is dipped in a resin bath 52. A computer controlled bobbin 54 moves in two orthogonal directions and guides the filament onto the surface of the rotating rotor 40. The winding pattern of the filament 48 onto the rotor 40 is preferably helical with dwell transitions at the top and bottom. The important factor in winding the filament 48 to form the reinforcement shell 34 is that the filament be placed, not circumferentially, but at an oblique angle with respect to the plane of the rotor core fiber layers. The overwrapped helical winding of the reinforcement shell places its fibers obliquely (neither perpendicular nor parallel) to the plane of the laminated rotor core and to the rotor axis. Preferably, at least five full layers of filament 48 are wound onto the rotor 40 to build up the reinforcement shell. After winding, the filament layers are cured to form a strong, stiff shell 34 that reinforces the radial layers of the laminated core in a direction transverse to the core layers to prevent delamination.

Instead of winding a resin-dipped filament around the outside of the rotor billet, there are alternative ways to create the reinforcement shell 34. One alternative substitutes a unidirectional carbon fiber prepregnated tape for the resin-dipped filament. The processes for winding the tape onto the rotor billet is similar to that described above for winding the filament 48, but the tape is not dipped in resin and fewer passes are required due to the greater width of the tape.

Another alternative method of fabricating the reinforcement shell 34 is to use a braided overwrap instead of a wound filament or tape followed by resin transfer molding. The braided overwrap, similar to a tube sock, is fabricated from carbon or other fibers by knitting or a similar process to a shape that corresponds to that of the outside of the rotor billet, with the fibers of the overwrap oriented obliquely with respect to the rotor axis. The braided overwrap is placed on the rotor billet and both are inserted into a mold. Resin is then injected into the mold to saturate the braided overwrap and the outside of the rotor billet. The resin and the braided overwrap form the reinforcement shell 34.

Figure 6A:
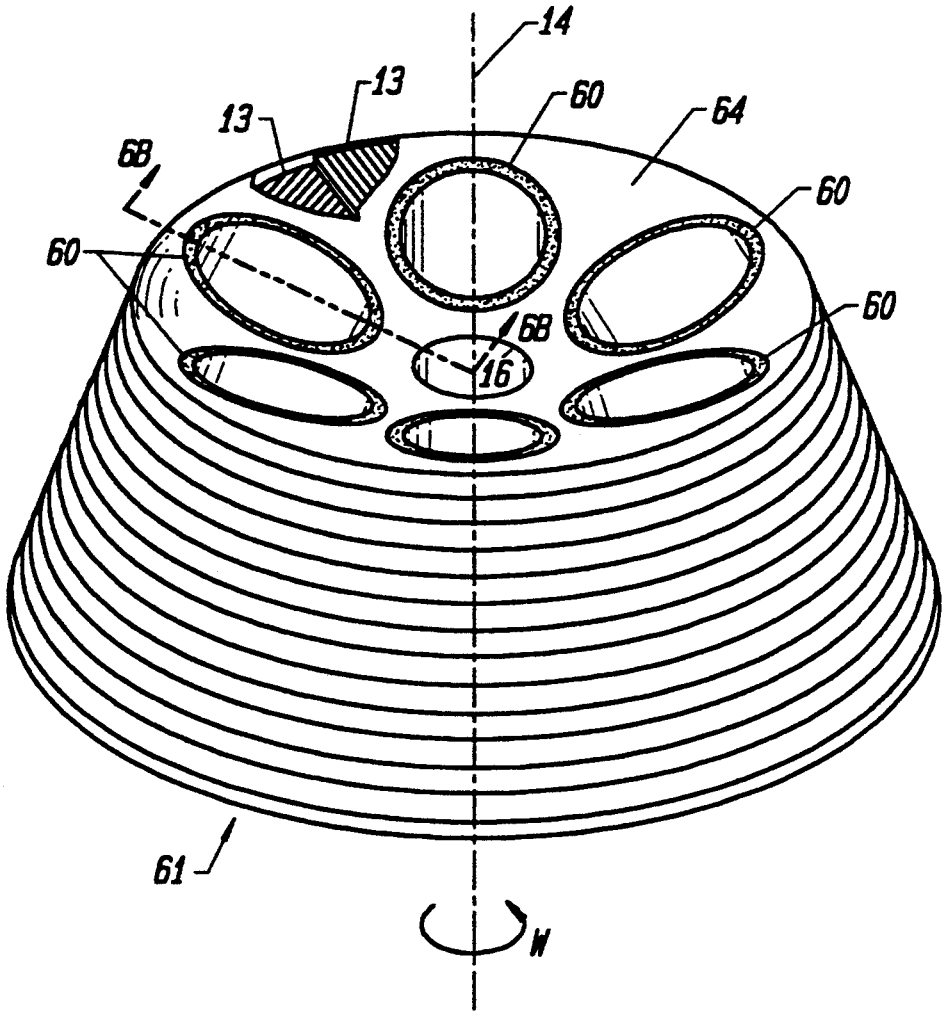
FIGS. 6A and 6B are a perspective view and a sectional view, respectively, of a fixed-angle centrifuge rotor of the present invention illustrating another embodiment of the invention, which reinforces the cell holes of the rotor with reinforcement cups.
Figure 6B:
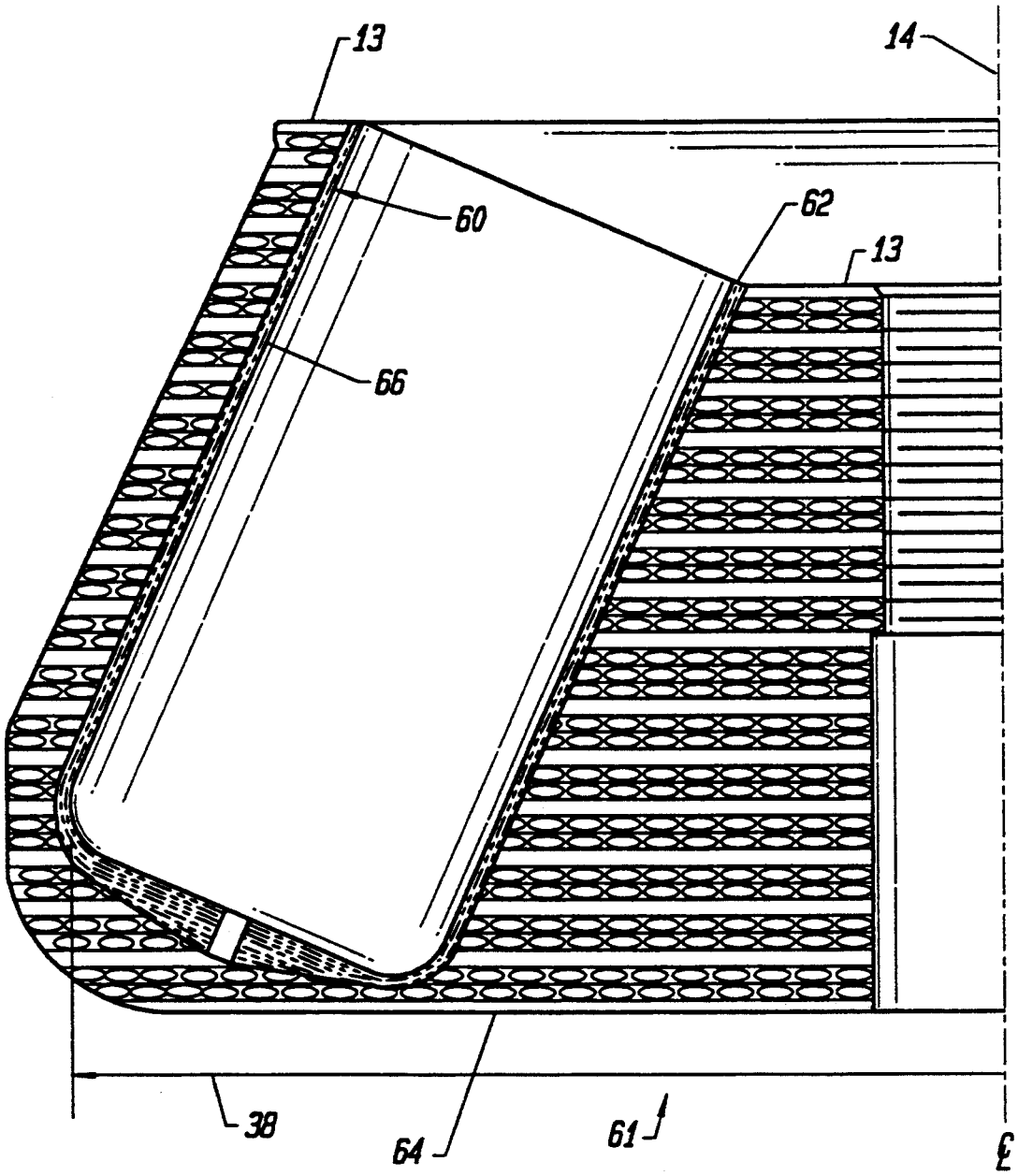
Figure 8:
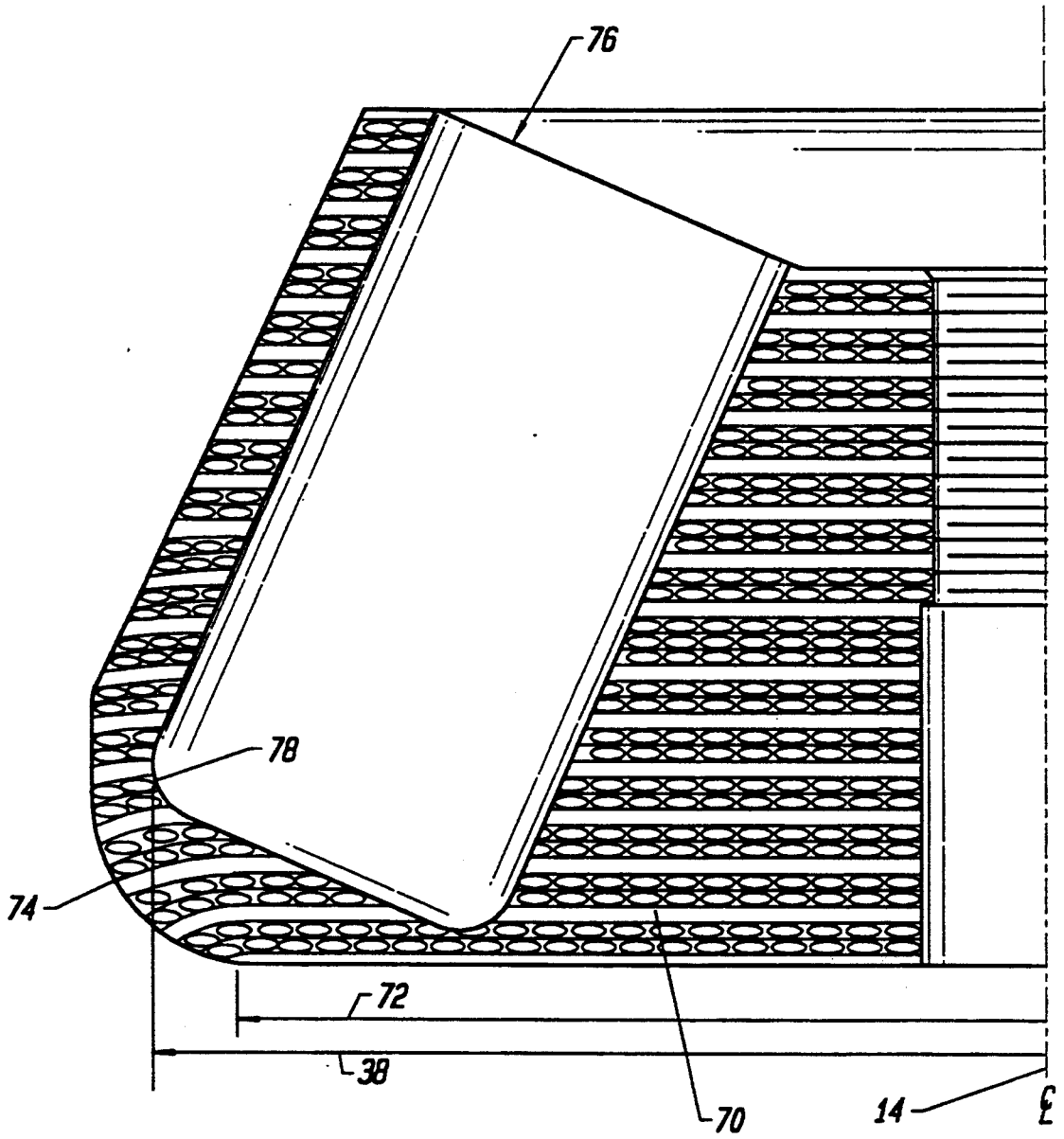
FIG. 8 is a sectional view of a fixed-angle centrifuge rotor of the present invention illustrating a further embodiment of the invention, which orients the radially-outer portions of laminated composite layers in a direction oblique to the rotor axis.
Figure 9A:
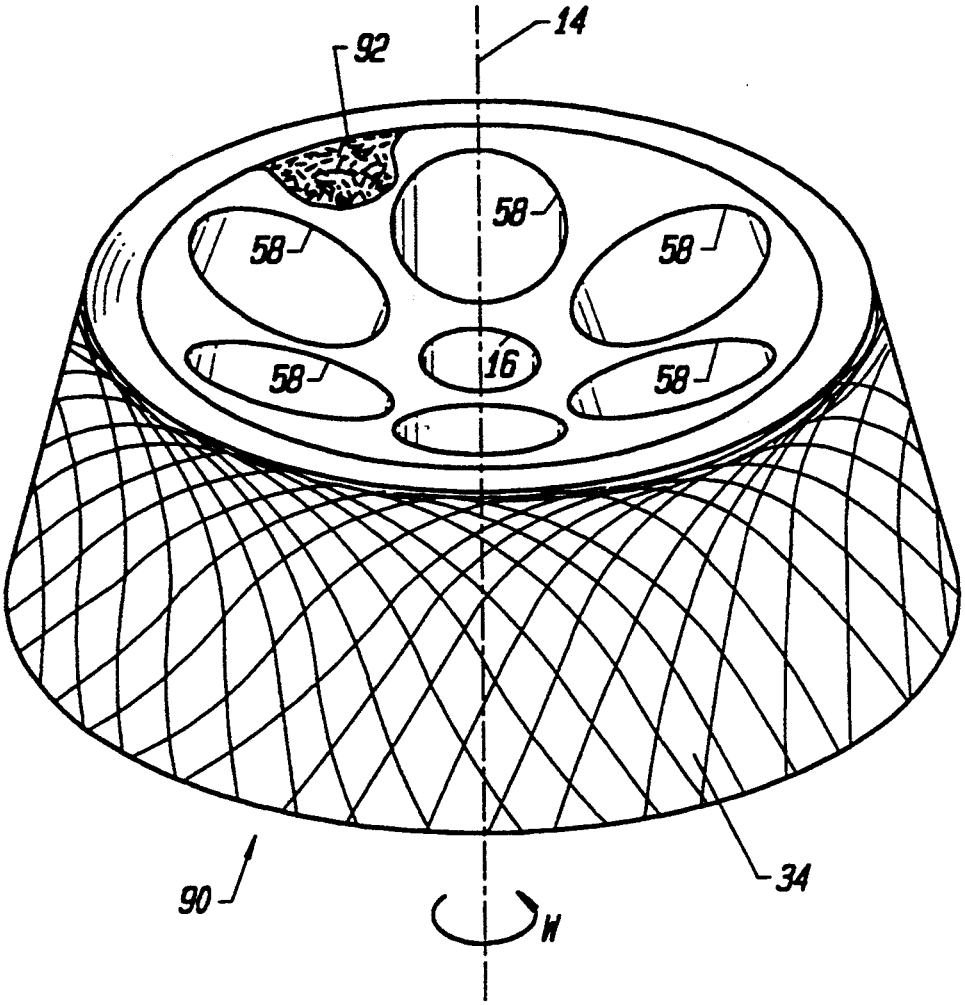
FIGS. 9A and 9B are a perspective view and a sectional view, respectively, of a fixed-angle centrifuge rotor of the present invention illustrating an embodiment of the invention having a random-fiber core and a reinforcement shell.
Figure 9B:
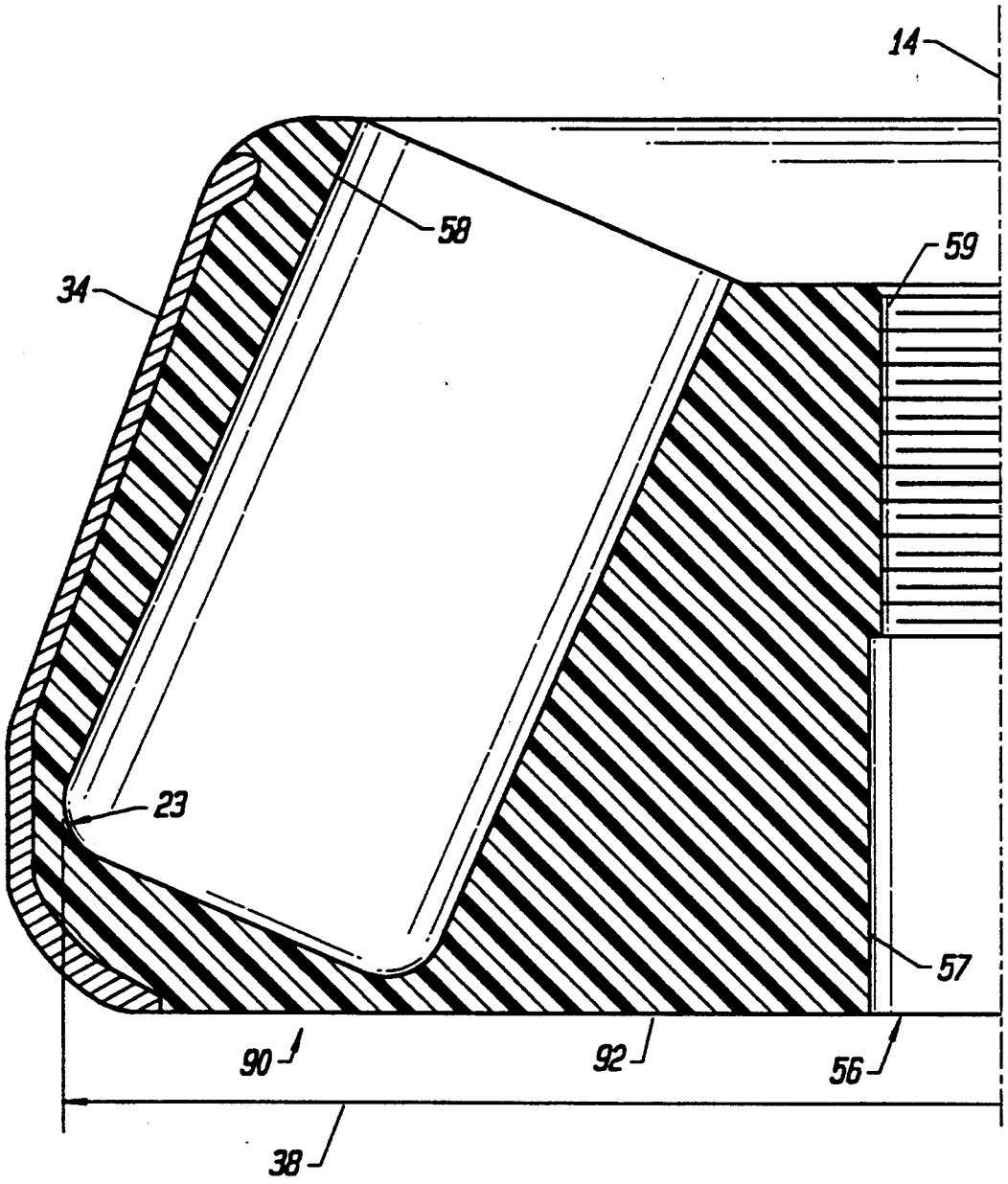

After the reinforcement shell 34 has been fabricated, the rotor is machined to final dimensions as shown in FIG. 3B. A hub 56 is fabricated along with several cell holes 58. The hub 56 includes a cylindrical bore 57 open to the bottom of the rotor and a female thread 59, both concentric with the rotor axis 14. The cell holes 58 are spaced symmetrically around the rotor axis 14 to maintain rotor balance. Since the fibers in the reinforcement shell 34 are oblique to the radial layers of the laminated core, the fibers take the load at region 23 transverse to the laminated layers that is caused by centrifuging samples at a fixed angle. Note that the layers 13 of resin-coated carbon fibers as illustrated in FIGS. 3B, 6B, and 8 are drawn thicker than actual.

A reinforcement shell of obliquely-oriented fibers of the types described above is useful in reinforcing other types of composite centrifuge rotors. A composite centrifuge rotor can also be fabricated by injection or compression molding a composite mixture of resin and chopped carbon fiber. Such a rotor would have the fibers oriented in random directions, which, compared to a laminated layer composite rotor, would improve the strength of the rotor parallel to the rotor axis, but would weaken the rotor in a radial direction. Adding a reinforcement shell of obliquely-oriented fibers on the outside of a molded composite rotor would improve its strength along the rotor axis as well as the radial and hoop strength. Thus, another embodiment of the present invention is a molded composite rotor with an outer reinforcement shell 34. This embodiment is illustrated as rotor 90 in FIGS. 9A and 9B. Rotor 90 has a core 92 of randomly-oriented fibers surrounded by a reinforcement shell 34.

Another approach to reinforcing the rotor core is illustrated in FIGS. 6A, 6B, 7A and 7B. The approach here in fabricating rotor 61 is to use a reinforcement cup 60 that contains the downward forces generated by the sample under centrifugation and transfers the forces in shear to a large area of the rotor core along the cylindrical wall of the cup. The reinforcement cup 60 is bonded to a blind hole 62 in the rotor core 64 and is fabricated of the same fiber-reinforced composite materials as the rotor core. The inside of the reinforcement cup 60 provides the cell hole 66 of the rotor.

Figure 7A:
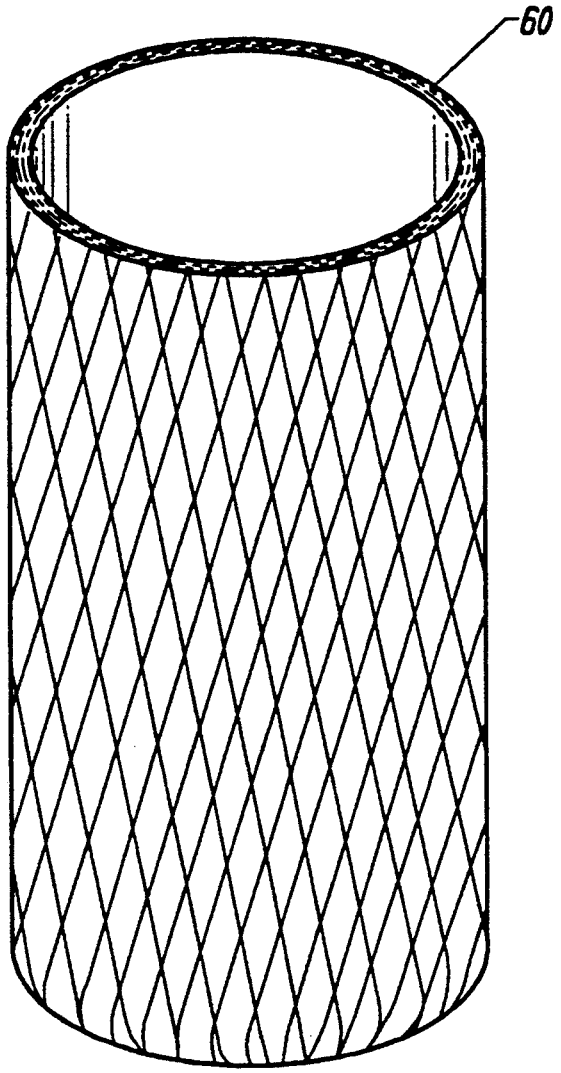
FIG. 7A is a perspective view of a reinforcement cup used in the rotor of FIG. 6.
Figure 7B:
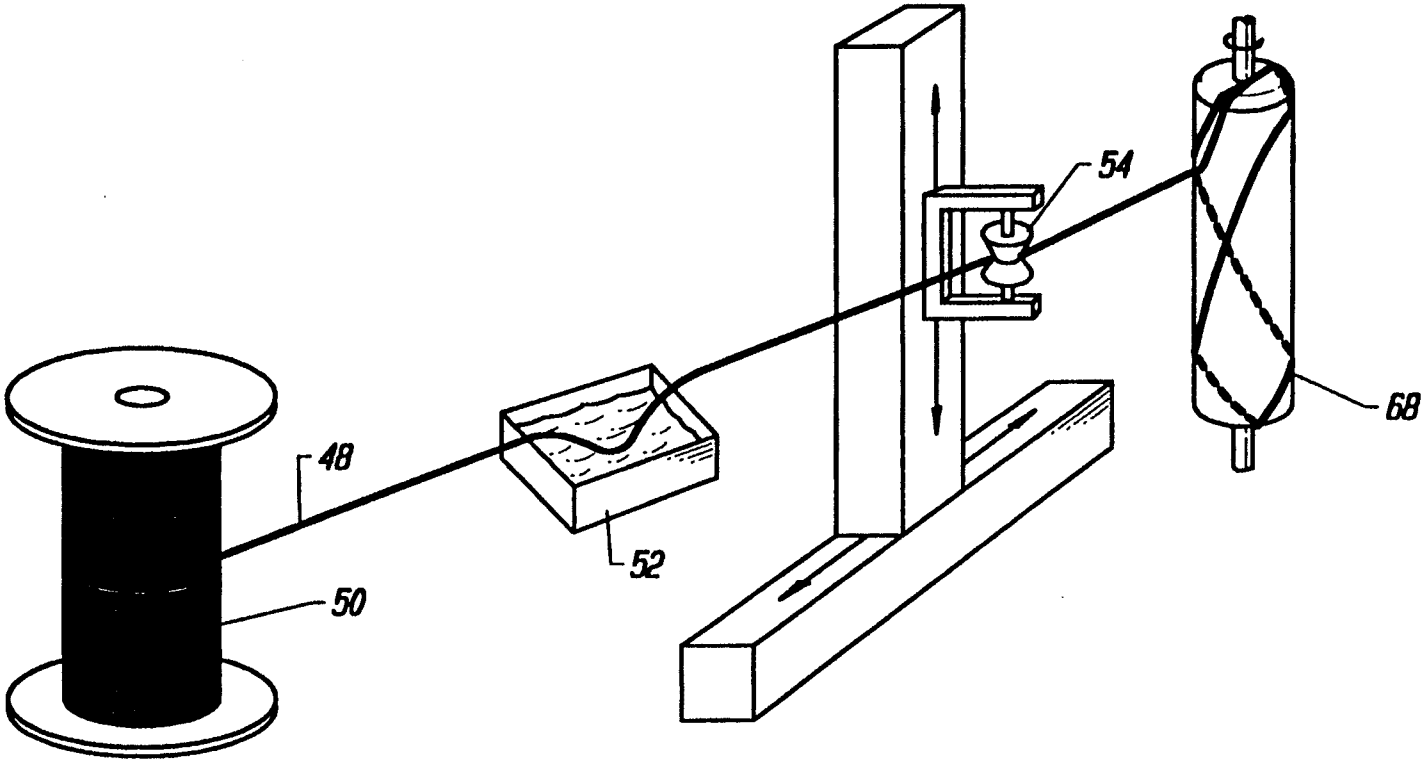
FIG. 7B is a perspective view of the reinforcement cup of FIGS. 6A and 6B and equipment used in its fabrication.

In building a rotor using this approach, a billet of several hundred parallel layers 13 of resin-coated carbon fibers is first fabricated as described above with respect to the reinforcement shell approach. After the billet is formed, it is machined to shape and blind holes 62 are drilled to accept the reinforcement cups 60. The reinforcement cups 60 are fabricated by helically winding a continuous filament or tape of resin dipped fibers over a cylindrical mandrel 68, as shown in FIG. 7B. The equipment used to wind the reinforcement cups is the same as that described above. After winding, the cylindrical filament wound shell is cured and cut into two halves to form two reinforcement cups 60, one of which is shown in FIG. 7A. The exterior of each reinforcement cup 60 is machined to fit into the blind holes 62 of the rotor 64. Then, the cups 60 are placed inside the holes 62 and bonded to the rotor 64 by structural adhesive.

The helically arranged fibers of the reinforcement cups 60 reinforce the rotor along the cell holes. The reinforcement cups 60 contain the forces that would otherwise delaminate the laminated rotor at region 23 and spread the forces out over a large area.

The hole in which the reinforcement cup is installed need not be a blind hole 62 as illustrated in FIG. 6B. Instead, a hole can be drilled through the rotor core and the reinforcement cup can be installed and bonded to the sides of the through hole. Of course in this embodiment, all the force on the reinforcement cup is transferred to the rotor core through shear forces in the bonding layer.

Also, the reinforcement cups 60 need not extend all the way to the tops of the cell holes as illustrated in FIG. 6B. Instead, a hole can be drilled through the rotor core and counterbored from the bottom to about one-half of the depth of the cell hole. Then, a reinforcement cup, having a height of about one-half that of reinforcement cup 60 of FIG. 6B, can be installed from below and bonded into the counterbored hole.

Still another embodiment of the present invention is illustrated in FIG. 8. Here, reinforcement of the cell hole in a direction parallel to the rotor axis is provided by orienting the radially-outer portions of laminated composite layers in a direction oblique (neither perpendicular nor parallel) to the rotor axis. The laminated layers 70 of the rotor extend radially from the rotor axis 14 up to a certain radius 72 that is less than the radius 38 of the radially outer portions 78 of the cell holes 76. Outside of the radius 72, the layers 74 are formed downward, thus orienting the fibers in that region so that they can absorb the downward load (force $R_2$ of FIG. 2) of the object in the cell hole 76. The region of oblique layers 74 includes the outside corner 78 of the cell hole 76 because that is the point of highest stress parallel to the rotor axis.

The region of oblique layers 74 is formed during the curing process of the rotor billet. Several hundred layers of unidirectional carbon fiber / epoxy prepregnated tape are stacked to the height of the rotor with the fibers oriented in various directions, all in planes normal to the rotor axis. The stack is then placed in a mold and cured under pressure at elevated temperatures to obtain a solid billet. The mold has a bottom plate that extends at right angles to the rotor axis out to radius 72 and then curves downward. A top plate has a mating surface that presses downward on the outer edges of the tape layers. Then, the billet is machined into the shape of a rotor core. The maximum curvature of the fibers is about 30 degrees from the plane normal to the rotor axis. The oblique layer region 74 could be curved upward instead of downward as shown in FIG. 8, but curved downward is preferred.

From the above description, it will be apparent that the invention disclosed herein provides a novel and advantageous fixed-angle centrifuge rotor fabricated from fiber-reinforced composite material, and an associated method of fabrication. The foregoing discussion discloses and describes merely exemplary methods and embodiments of the present invention. As will be understood by those familiar with the art, the invention may be embodied in other specific forms without departing from the spirit or essential characteristics thereof. For example, the three means for reinforcing the high stress areas of the cell holes, namely, the reinforcement shell, the reinforcement cup, and the oblique outer layers, can be used together in combination to further strengthen the rotor beyond that achievable through only one such means.

Accordingly, the disclosure of the present invention is intended to be illustrative, but not limiting, of the scope of the invention, which is set forth in the following claims.

What is claimed is:

1. A fixed-angle centrifuge rotor having a rotor axis that is a vertical axis of rotation and comprising:

a rotor core having laminated layers of fiber-reinforced composite material with the layers arranged normal to the rotor axis and bound together with resin, the rotor core including at least one cell hole having a top tilted toward the rotor axis at an oblique angle and having a bottom with a radially outer portion thereof located at a first radius from the rotor axis;

means for attaching the rotor to a spindle of a centrifuge; and reinforcement means for reinforcing the rotor core proximate the radially outer portion of the bottom of said at least one cell hole in a direction parallel to the rotor axis, the reinforcement means including fiber-reinforced composite material having a continuous region of oblique fibers oriented obliquely to the rotor axis, wherein the continuous region of oblique fibers extends above the radially outer portion of the bottom of said at least one cell hole to a radius less than the first radius, and wherein the continuous region of oblique fibers extends below the radially outer portion of the bottom of said at least one cell hole to a radius less than the first radius.

2. A centrifuge rotor as recited in claim 1 wherein the reinforcement means includes a reinforcement shell of fiber-reinforced composite material extending over a portion of the periphery of the rotor core above and below the radially outer portion of the bottom of said at least one cell hole, and wherein the reinforcement shell has an upper edge and a lower edge that extend radially inward toward the rotor axis to a radius less than the first radius.

3. A centrifuge rotor as recited in claim 2 wherein the fibers of the reinforcement shell are disposed in a helical pattern over the periphery of the rotor core.

4. A centrifuge rotor as recited in claim 1 wherein the reinforcement means includes a region of the laminated layers of fiber-reinforced composite material in which the fibers are oriented obliquely to the rotor axis, and wherein said region is located at a radially outer area of the rotor.

5. A centrifuge rotor as recited in claim 4 wherein the laminated layers of fiber-reinforced composite material extend in planes normal to the rotor axis up to a second radius that is less than the first radius and extend outward from the second radius in directions oblique to the rotor axis.

6. A fixed-angle centrifuge rotor having a rotor axis that is a vertical axis of rotation and comprising:

a rotor core composed of fiber-reinforced composite material, the rotor core including at least one cell hole having an open top tilted toward the rotor axis at an oblique angle and having a closed bottom with a radially outer portion thereof located at a first radius from the rotor axis;

means for attaching the rotor to a spindle of a centrifuge; and a reinforcement shell of fiber-reinforced composite material extending over a portion of the periphery of the rotor core above and below the radially outer portion of the bottom of said at least one cell hole and containing fibers oriented obliquely with respect to the rotor axis, wherein the reinforcement shell has an upper edge and a lower edge that each extend radially inward toward the rotor axis to a radius less than the first radius.

7. A fixed-angle centrifuge rotor as recited in claim 6 wherein the rotor core is composed of laminated layers of fiber-reinforced composite material with the layers arranged normal to the rotor axis and bound together with resin.

8. A fixed-angle centrifuge rotor as recited in claim 6 wherein the rotor core is composed of a composite mixture of resin and randomly-oriented chopped carbon fibers.

* * * * *